United States Patent [19]

Pu et al.

[11] 4,218,529

[45] Aug. 19, 1980

[54] ELECTROPHOTOGRAPHIC PHOTOSENSITIVE MATERIAL HAVING A QUINOCYANINE PIGMENT PHOTOCONDUCTOR

[75] Inventors: Lyong S. Pu; Hitoshi Kamoda, both of Minami-ashigara, Japan

[73] Assignee: Fuji Xerox Co., Ltd., Tokyo, Japan

[21] Appl. No.: 838,290

[22] Filed: Sep. 30, 1977

[30] Foreign Application Priority Data

Sep. 30, 1976 [JP] Japan ..... 51-116640

[51] Int. Cl.[2] ..... G03G 5/06

[52] U.S. Cl. ..... 430/78; 430/58

[58] Field of Search ..... 96/1.5, 1.6, 132, 133, 96/137

[56] References Cited

U.S. PATENT DOCUMENTS

| | | | |
|---|---|---|---|
| 2,951,841 | 9/1960 | Wilson | 96/133 |
| 3,482,981 | 12/1969 | Van Lare | 96/133 |
| 3,796,573 | 3/1974 | Jones | 96/1.6 |
| 3,879,197 | 4/1975 | Bartlett et al. | 96/1.6 |
| 3,982,935 | 9/1976 | Bartlett et al. | 96/1 R |

*Primary Examiner*—Roland E. Martin, Jr.
*Assistant Examiner*—John L. Goodrow
*Attorney, Agent, or Firm*—Sughrue, Rothwell, Mion, Zinn and Macpeak

[57] ABSTRACT

An electrophotographic photosensitive material comprising an electrically conductive support having thereon a photoconductive layer containing, as an essential component, an organic photoconductive material, in which the photoconductive layer contains in a dispersed state a quinocyanine pigment represented by the following general formula (I)

(I)

wherein A is selected from the group consisting of wherein B represents an unsubstituted or substituted alkyl group having 1 to 8 carbon atoms, an unsubstituted or substituted aromatic residue, a quinolinium residue, a halogen atom, a nitro group or a cyano group; $R_1$ and $R_2$, which may be the same or different, each represents an unsubstituted or substituted alkyl group having 1 to 8 carbon atoms or an allyl group; X represents an anion, and the two quinoline nuclei may have additional substituents.

15 Claims, No Drawings

ELECTROPHOTOGRAPHIC PHOTOSENSITIVE MATERIAL HAVING A QUINOCYANINE PIGMENT PHOTOCONDUCTOR

BACKGROUND OF THE INVENTION

1. Field of the Invention

This invention relates to electrophotographic photosensitive materials used in electrophotographic processes. More particularly, it relates to electrophotographic photosensitive materials in which a photoconductive layer contains a quinocyanine pigment having a particular molecular structure.

2. Description of the Prior Art

As electrophotographic photosensitive materials, inorganic photosensitive materials such as amorphous selenium, selenium alloys, cadmium sulfide and zinc oxide and organic photosensitive materials which include, typically, polyvinylcarbazole and derivatives thereof, are widely known at present.

Amorphous selenium and selenium alloys have very excellent characteristics as electrophotographic photosensitive materials and, therefore, they have been put to practical use, as is well known. They, however, have disadvantages in that their preparation requires complicated processes for deposition and, further, the deposited film formed is not flexible. Zinc oxide is used in the form of photosensitive materials of the dispersion type in which it is dispersed in a resin. Such photosensitive materials have a defect in mechanical strength, so that they are not suitable for repeated operation as they are.

Polyvinylcarbazole which is widely known as an organic photoconductive material has excellent transparency, film-forming properties, flexibility, etc., but itself exhibits no sensitivity in the visible region. Since polyvinylcarbazole, per se, cannot, therefore, be put to practical use, various sensitizing methods have been devised. However, spectral sensitization of polyvinylcarbazole with a sensitizing dye cannot provide sufficient electric characteristics for electrophotographic photosensitive materials, although the spectral sensitivity region is extended into the visible region, and is disadvantageous in that light fatigue is marked. Further, chemical sensitization with an electron-accepting compound can provide satisfactory photographic photosensitive materials from the standpoint of sensitivity, and some such photosensitive materials have been put to practical use, but problems still remain with respect to mechanical strength, life, etc.

Organic photosensitve materials of the dispersion type have been actively studied, and many reports have been made thereon. However, photosensitive materials having excellent electrical characteristics and satisfactory sensitivity as an electrophotographic photosensitive material have still not yet been obtained.

At the present time, it is reported that phthalocyanine exhibits excellent electrophotographic characteristics when used as a photosensitive material of the dispersion type, but the spectral sensitivity of phthalocyanine lies rather toward longer wavelengths and, therefore, it has the defect of poor red-reproducibility.

SUMMARY OF THE INVENTION

Extensive investigations have been made to overcome various problems encountered with the above-described conventional inorganic photosensitive materials, organic photosensitive materials and organic photosensitive materials of the dispersion type and to obtain photoconductive materials having excellent electrophotographic characteristics and flexibility, and as a result, this invention has been achieved.

An object of this invention is to provide extremely highly-sensitive photoconductive materials which can be used in any existing electrophotographic processes and which have spectral sensitivity over the entire visible light region.

Another object of this invention is to provide extremely highly-sensitive electrophotographic photosensitive materials which have excellent mechanical strength such as wear resistance, which have flexibility that inorganic photosensitive materials are lacking, in which the inferior wear resistance and insufficient mechanical strength that are defects of polyvinylcarbazole-trinitrofluorenone organic photosensitive materials are improved, and which have a substantially flat spectral sensitivity over the entire visible light region.

The electrophotographic photosensitive material of this invention comprises a conductive support having thereon a photoconductive layer containing in a dispersed state a quinocyanine pigment represented by the following general formula (I)

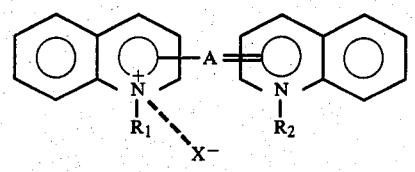

(I)

wherein A is selected from the group consisting of

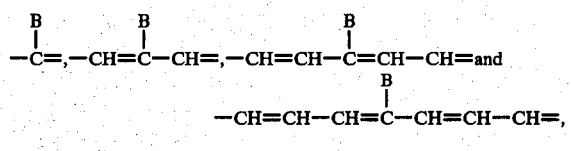

wherein B represents an unsubstituted or substituted alkyl group having 1 to 8 carbon atoms, an unsubstituted or substituted aromatic residue, a quinolinium residue or a halogen atom (e.g., F, Cl, Br, I, etc.); $R_1$ and $R_2$, which may be the same or different, each represents an unsubstituted or substituted alkyl group having 1 to 8 carbon atoms or an allyl group; X represents an anion such as $I^-$, $Br^-$, $Cl^-$, $ClO_4^-$, $BF_4^-$, $R_3SO_3^-$ and so on, wherein $R_3$ represents an unsubstituted alkyl group having 1 to 4 carbon atoms such as $CH_3$, $C_2H_5$, $C_3H_7$ and $C_4H_9$, or an unsubstituted or substituted phenyl group; and the two quinoline nuclei may have additional substituents.

DETAILED DESCRIPTION OF THE INVENTION

In the above general formula (I), suitable examples of substituted alkyl groups for B in which the alkyl moiety thereof has 1 to 8 carbon atoms include $—CH_2C_6H_5$, $—CH_2CH_2Cl$, $—CH_2CH_2OH$, $—CH_2CH_2COOCH_3$, etc. and suitable examples of substituents in the aromatic residues for B include an unsubstituted alkyl group having 1 to 4 carbon atoms (e.g., $CH_3$, $C_2H_5$, $C_3H_7$ and $C_4H_9$); a halogen atom (e.g., F, Cl, Br, I, etc.), a nitro group, a hydroxyl group, etc. Examples of suitable unsubstituted alkyl groups for $R_1$ and $R_2$ are $—CH_3$, $—C_2H_5$, $—C_3H_7$, $—C_4H_9$, $—C_5H_{11}$, $—C_6H_{13}$, $—C_7H_{15}$ and $—C_8H_{17}$ and examples of substituted alkyl groups in which the alkyl moiety thereof has 1 to 8 carbon atoms include groups such as $-CH_2C_4H_5$, $-CH_2CH_2Cl$, $-CH_2CH_2COOH$, $-CH_2CH_2CN$, $-CH_2CH_2OH$, etc. Suitable substitutents in the substituted phenyl groups for $R_3$ include one or more of an alkyl group, a halogen atom (e.g., F, Cl, Br, I, etc.), a hydroxyl group, an amino group, etc.

Specific examples of the quinocyanine pigments represented by the above general formula are shown in terms of structural formulae. The invention, however, is not to be construed as being limited to these specific examples.

Pigment (1)

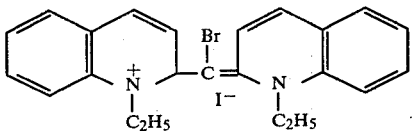

1,1'-Diethyl-9-bromoquinocyanine iodide

Pigment (2)

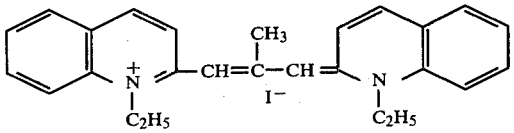

1,1'-Diethyl-10-methylquinocarbocyanine iodide

Pigment (3)

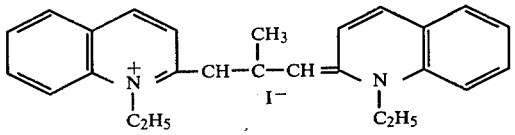

1,1'-Diethyl-10-ethylquinocarbocyanine iodide

Pigment (4)

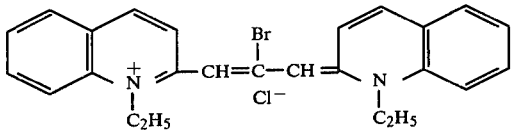

1,1'-Diethyl-10-bromoquinocarbocyanine chloride

Pigment (5)

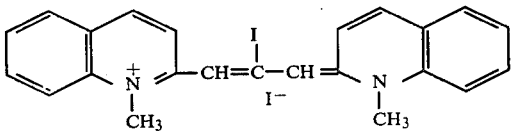

1,1'-Dimethyl-10-iodoquinocarbocyanine iodide

Pigment (6)

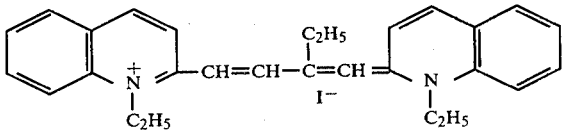

1,1'-Diethyl-11-ethylquinodicarbocyanine iodide

-continued
Pigment (7)
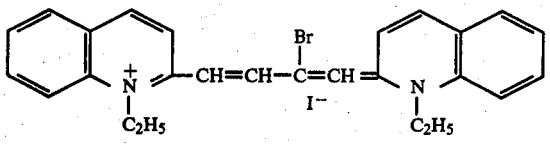
1,1'-Diethyl-11-bromoquinodicarbocyanine iodide
Pigment (8)
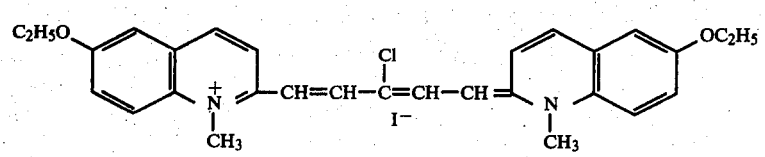
1,1'-Dimethyl-6,6'-diethoxy-11-chloroquinodicarbocyanine iodide
Pigment (9)
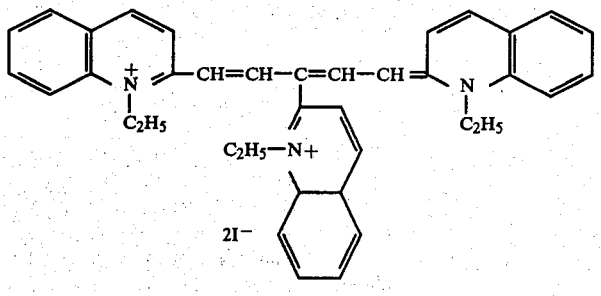
1,1',1''-Triethyl-11-(2''-quinolyl)-2,2'-quinodicarbocyanine diiodide
Pigment (10)
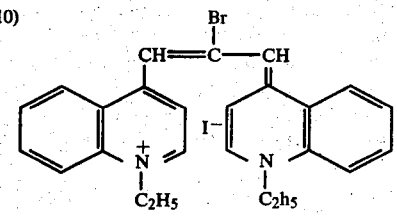
1,1'-Diethyl-10-bromo-4,4'-quinocarbocyanine iodide
Pigment (11)
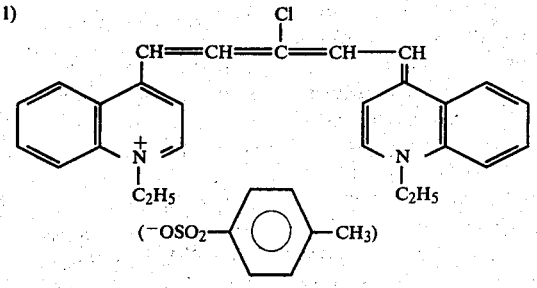
1,1'-Diethyl-11-chloro-4,4'-quinodicarbocyanine para-toluenesulfonate -continued Pigment (12)

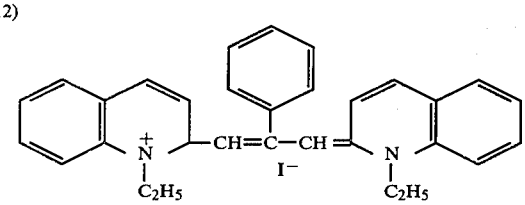

1,1'-Diethyl-10-phenylquinocarbocyanine iodide

Pigment (13)

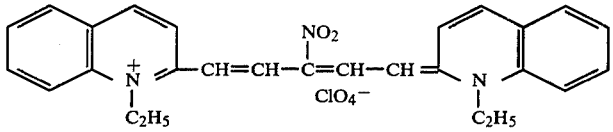

1,1'-Diethyl-11-nitroquinodicarbocyanine perchlorate

Pigment (14)

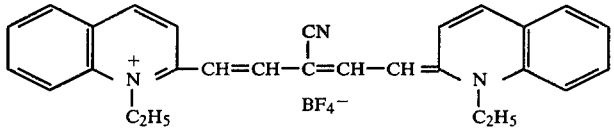

1,1'-Diethyl-11-cyanoquinodicarbocyanine tetrafluoroborate

According to this invention, the quinocyanine pigments represented by the above general formula (I) can also be employed with electrophotographic photosensitive materials having a multilayer structure. That is, as for electrophotographic photosensitive materials which contain a photoconductive layer having a two layer structure comprising a charge-generating layer and a charge-transporting layer, an improvement in the charging property, reduction of residual potential, further, an improvement in mechanical strength, and the like, can be achieved by incorporating the above-described quinocyanine pigment in the charge-generating layer and the charge-transporting layer of, e.g., polyvinylcarbazole.

In this invention, the quinocyanine pigments of the above general formula (I) are dispersed in a binder. The pigment particles need not have a particle size of the order of a molecular size or a size nearly a molecular size. A desirable particle size of the pigment particles in terms of diameter of about 5μ or less, preferably 1μ or less. The pigment to be dispersed in a binder is previously ground. Such grinding can be performed using known methods employing a SPEX MILL (trade name, made by Spex Inc. U.S.A.), a ball mill, RED DEVIL (trade name made by Red Devil Inc. U.S.A.), or the like. As described above, satisfactory electrophotographic characteristics can be obtained with the pigment having a particle size of about 5μ or less, preferably 1μ or less, in diameter. It is undesirable, as described above to grind the pigment into a size near a molecular size, since the electrophotographic characteristics are decreased. The ground pigment of a size of about 5μ or less is added in an amount of about 5 to about 90 wt %, preferably 10 to 60 wt %, to a binder and dispersed therein.

The binder per se may or may not be photoconductive. Binders which are photoconductive (charge-transporting matrixes) include photoconductive polymers such as polyvinylcarbazole, polyvinylcarbazole derivatives, polyvinyl naphthalene, polyvinyl anthracene and polyvinyl pyrene, other organic matrixes having a charge-transporting ability, etc. These binders can be used in combination with known dye sensitizers. Effective dye sensitizers which can be used include triphenylmethane dyes such as Crystal Violet, Malachite Green, and Brilliant Green; xanthene dyes such as Rhodamine B and Rhodamine 6G; thiazine dyes such as Methylene Blue and New Methylene Blue; and the like. Further, chemical sensitizers can be used in combination therewith. Examples of effective chemical sensitizers are electron-accepting materials such as trinitrofluorenone, tetranitrofluorenone, dinitrodibenzothiophene dioxide and picric acid. The above dye sensitizer and the above chemical sensitizer, of course, can be effectively used in combination.

Known electrically insulating resins which are not photoconductive can also be used as a binder. Examples of known insulating resins which can be used include polystyrene, polyesters, polyvinyl toluene, polyvinyl anisole, polyfluorostyrene, polyvinyl butyral, polyvinyl acetal, polyvinyl butyl methacrylate, styrene-butadiene copolymers, polysulfone, styrene-methyl methacrylate copolymers, polycarbonate, etc.

In order to further improve the mechanical strength of the resulting photosensitive material, plasticizers can be used, just as in the case of usual high-molecular weight materials. Chlorinated paraffin, chlorinated biphenyl, phosphate plasticizers, phthalate plasticiders, and the like, can be used as plasticizers. The plasticizer can be employed in an amount of 0 to about 60 wt % based on the weight of the binder to further improve the mechanical strength of the photosensitive material without decreasing its sensitivity and electrical characteristics.

The binder containing the above-described quinocyanine pigment in a dispersed state is coated on an electrically conductive support. Coating methods such as dip coating, spray coating or coating using an applicator can be used. Satisfactory photosensitive layers can be formed using any of these coating methods.

Electrically conductive supports which can be used include metals, papers, high-molecular weight films and Nesa glass, whose surfaces are treated so as to be rendered electrically conductive.

The following examples are given to illustrate this invention in more detail. Unless otherwise indicated, all parts, percents ratios and the like are by weight.

EXAMPLE 1

Pigment (2) described hereinbefore was placed together with tetrahydrofuran (THF) in a ball mill and ground for 48 hours. The ground pigment (2) was mixed in an amount of 20 wt % in a binder, Du Pont Mylar 49000, dissolved in THF. The mixture was coated on an aluminum plate using an applicator and dried at 70° C. for 60 min. The thickness of the film formed was about 10μ on a dry basis. The electrical characteristics of the thus obtained photosensitive material were determined using an Electrostatic Paper Analyzer made by Kawaguchi Electric Co., Ltd. As a result, in the case of positive charging, the amount of exposure required for a reduction of the initial potential by one-half was 3 lux.sec.

EXAMPLES 2 TO 10

Photosensitive materials were prepared in the same manner as in Example 1 using Pigments (3) to (9), (13) and (14) described hereinbefore as replacements for Pigment (2) used therein. Their electrical characteristics were determined. The results obtained are shown in Table 1 below.

Table 1

| Example No. | Pigment | $V_0^{\oplus}$ | $E_{\frac{1}{2}}^{\oplus}$ | $V_0^{\ominus}$ | $E_{\frac{1}{2}}^{\ominus}$ |
|---|---|---|---|---|---|
| 2 | (3) | 750 | 1.5 | 7905 | 3.2 |
| 3 | (4) | 820 | 2.5 | 770 | 5.3 |
| 4 | (5) | 800 | 2.7 | 760 | 5.8 |
| 5 | (6) | 790 | 2.3 | 745 | 5.0 |
| 6 | (7) | 815 | 1.6 | 780 | 2.9 |
| 7 | (8) | 690 | 2.0 | 650 | 4.2 |
| 8 | (9) | 785 | 3.3 | 735 | 7.1 |
| 9 | (13) | 635 | 5.0 | 600 | 9.5 |
| 10 | (14) | 715 | 4.5 | 705 | 8.7 |

In the above table, $V_O^{\oplus}$ and $V_O^{\ominus}$ denote potentials induced by charging with C.C. currents of +50 μA and −50 μA, respectively, and the amount of exposure required for a reduction of the initial potential by one-half ($E_{\frac{1}{2}}$) was determined by irradiation with light of 5 lux. from a tungsten lamp. In all cases, the thickness of the film formed was about 10μ.

EXAMPLE 11

Pigment (7) described hereinafter was placed together with steel balls and THF in a test tube and ground for 12 hours using a RED DEVIL mill. The ground pigment was mixed in an amount of 30 wt % with a binder, Du Pont Mylar 49000, dissolved in THF. The thus obtained mixture was coated on an aluminum sheet using an applicator so as to provide a film thickness of about 10μ on a dry basis, and dried at 70° C. for 60 min. The electrical characteristics of the thus obtained photosensitive material were determined in the same manner as in Example 1. As a result, in the case of positive charging, the amount of exposure required for a reduction in the initial potential by one-half was 1.5 lux.sec. and the characteristics necessary for repeated operation were also very satisfactory.

EXAMPLE 12

Pigment (7) as described hereinbefore was ground in the same manner as in Example 1 and mixed in an amount of 60 wt % with a binder. The mixture was coated on an aluminum plate so as to provide a film thickness of about 1μ, and polyvinylcarbazole was further coated thereon using an applicator. After drying at 70° C. for 60 min., the thickness of the film formed was about 12μ. The electrical characteristics of the thus obtained laminated photosensitive material were determined in the same manner as in Example 1. As a result, in the case of negative charging, the amount of exposure required for a reduction in the initial potential by one-half was 1.2 lux.sec.

EXAMPLE 13

Pigment (3) was ground in the same manner as in Example 11 and mixed in an amount of 30 wt % with polyvinylcarbazole which had been dissolved in THF and 0.05 wt % of Crystal Violet was additionally added thereto. The mixture was coated on an aluminum plate using an applicator and dried at 70° C. for 5 hours. When the thus obtained photosensitive material was positively charged, the amount of exposure required for a reduction in the initial potential by one-half was 8 lux.sec.

EXAMPLE 14

A photosensitive material was prepared in the same manner as in Example 11 but using Pigment (11). As a result of the determination of the electrical characteristics, in the case of positive charging, the amount of exposure required for a reduction in the initial potential by one-half was 12 lux.sec.

While the invention has been described in detail and with reference to specific embodiments thereof, it will be apparent to one skilled in the art that various changes and modifications can be made therein without departing from the spirit and scope thereof.

What is claimed is:

1. An electrophotographic photosensitive material comprising an electrically conductive support having thereon a photoconductive layer consisting essentially of an organic photoconductive material and a binder, in which the photoconductive layer contains in a dispersed state a photoconductive quinocyanine pigment having a particle size of about 5μ or less represented by the following general formula (I)

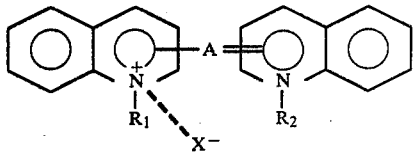

(I)

wherein A is selected from the group consisting of

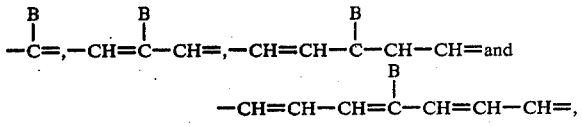

wherein B represents an unsubstituted or substituted alkyl group having 1 to 8 carbon atoms, an unsubstituted or substituted aromatic residue, a quinolinium residue, a halogen atom, a nitro group or a cyano group, $R_1$ and $R_2$, which may be the same or different, each represents an unsubstituted or substituted alkyl group having 1 to 8 carbon atoms or an allyl group; X represents an anion; and the two quinoline nuclei may have additional substituents.

2. The electrophotographic photosensitive material of claim 1, wherein said photoconductive layer comprises a two-layer structure comprising a charge-generating layer and a charge-transporting layer with the quinocyanine pigment represented by the general formula (I) being present in said charge-generating layer of the photoconductive layer.

3. The electrophotographic photosensitive material as claimed in claim 1, wherein said photoconductive layer contains an electrically insulating resin and said quinocyanine pigment represented by the general formula (I) is dispersed in said resin.

4. The electrophotographic photosensitive material as claimed in claim 2, wherein said charge-generating layer additionally contains an electrically insulating resin and said quinocyanine pigment represented by the general formula (I) is dispersed in said resin.

5. The electrophotographic photosensitive material as claimed in claim 1, wherein said photoconductive layer contains a charge-transporting matrix and said quinocyanine pigment represented by the general formula (I) is dispersed in said charge-transporting maxtrix.

6. The electrophotographic photosensitive material as claimed in claim 3, wherein said electrically insulating resin contains about 5 to about 90 weight % of said quinocyanine pigment represented by the general formula (I).

7. The electrophotographic photosensitive material as claimed in claim 4, wherein said electrically insulating resin contains about 5 to about 90 weight % of said quinocyanine pigment represented by the general formula (I).

8. The electrophotographic photosensitive material, as claimed in claim 5, wherein said charge-transporting matrix contains about 5 to about 90 weight % of said quinocyanine pigment represented by the general formula (I).

9. The electrophotographic photosensitive material as claimed in claim 6, wherein said charge-transporting matrix contains about 5 to about 90 weight % of said quinocyanine pigment represented by the general formula (I).

10. The electrophotographic photosensitive material as claimed in claim 1, wherein B represents said substituted or unsubstituted alkyl group.

11. The electrophotographic photosensitive material as claimed in claim 1, wherein B represents said unsubstituted or substituted aromatic residue.

12. The electrophotographic photosensitive material as claimed in claim 1, wherein B represents said quinolinium residue.

13. The electrophotographic photosensitive material as claimed in claim 1, wherein B represents said halogen atom.

14. The electrophotographic photosensitive material as claimed in claim 1, wherein B represents said nitro group.

15. The electrophotographic photosensitive material as claimed in claim 1, wherein B represents said cyano group.

* * * * *